United States Patent [19]

Morita et al.

[11] Patent Number: 4,502,897

[45] Date of Patent: Mar. 5, 1985

[54] METHOD FOR PRODUCING HOT-ROLLED STEEL SHEETS HAVING A LOW YIELD RATIO AND A HIGH TENSILE STRENGTH DUE TO DUAL PHASE STRUCTURE

[75] Inventors: Masahiko Morita; Junichi Mano; Minoru Nishida; Tomoo Tanaka; Nobuo Aoyagi; Syoichi Takizawa, all of Kurashiki, Japan

[73] Assignee: Kawasaki Steel Corporation, Kobe, Japan

[21] Appl. No.: 438,844

[22] PCT Filed: Feb. 2, 1982

[86] PCT No.: PCT/JP82/00030

§ 371 Date: Oct. 15, 1982

§ 102(e) Date: Oct. 15, 1982

[87] PCT Pub. No.: WO82/02902

PCT Pub. Date: Sep. 2, 1982

[30] Foreign Application Priority Data

Feb. 20, 1981 [JP] Japan ..... 56-22877

[51] Int. Cl.[3] ..... C21D 8/02

[52] U.S. Cl. ..... 148/12 F; 148/12.4; 148/36

[58] Field of Search ..... 148/12 F, 12.4, 36

[56] References Cited

U.S. PATENT DOCUMENTS

| | | | |
|---|---|---|---|
| 4,072,543 | 2/1978 | Coldren et al. | 148/36 |
| 4,316,753 | 2/1982 | Kaneko et al. | 148/12 F |
| 4,325,751 | 4/1982 | Josefsson | 148/12 F |
| 4,388,122 | 6/1983 | Sudo et al. | 148/12.4 |
| 4,421,573 | 12/1983 | Irie et al. | 148/12.4 |

FOREIGN PATENT DOCUMENTS

| | | | |
|---|---|---|---|
| 54-65118 | 5/1979 | Japan | 148/12 F |
| 55-34659 | 3/1980 | Japan | 148/12 F |
| 55-91934 | 7/1980 | Japan | 148/12 F |

*Primary Examiner*—Peter K. Skiff

*Attorney, Agent, or Firm*—Balogh, Osann, Kramer, Dvorak, Genova & Traub

[57] ABSTRACT

The present invention aims to obtain C-Si-Mn-Cr system of hot-rolled dual phase structured steel sheets having a low yield ratio YR of not greater than 65%, an excellent strength-elongation balance M, a low variation in quality and an excellent cold formability through stepwise cooling regulation in the course of cooling from the final rolling to coiling.

The present invention is a method for producing hot-rolled steel sheets having a low yield ratio and a high tensile strength due to dual phase structure by effecting the final rolling of a hot-rolled steel sheet containing 0.02–0.2% of C, 0.05–2.0% of Si, 0.5–2.0% of Mn and 0.3–1.5% of Cr as the essential components at a temperature of finishing the final rolling of 780° C., rapidly cooling the thus treated steel sheet at a cooling rate of more than 40° C./S to the temperature range wherein the transformation of $\gamma$ into $\alpha$ is efficiently caused corresponding to the components in the steel and the rolling hysteresis, holding the steel sheet at this temperature range for more than 5 seconds and rapidly cooling the thus treated steel sheet at a cooling rate of more than 50° C./S from said held temperature to a temperature of 550°–200° C. to obtain a hot-rolled steel sheet having YR of not greater than 65%, M of not less than 60 and a low variation of quality and an excellent cold formability.

2 Claims, 3 Drawing Figures

METHOD FOR PRODUCING HOT-ROLLED STEEL SHEETS HAVING A LOW YIELD RATIO AND A HIGH TENSILE STRENGTH DUE TO DUAL PHASE STRUCTURE

FIELD OF THE INVENTION

The present invention relates to a method for producing hot-rolled steel sheets having a low yield ratio and a high tensile strength due to dual phase structure and intends to clarify the range of cooling regulating conditions for producing a hot-rolled steel sheet having a low yield ratio and a high tensile strength, and provided with the properties same as or higher than those accomplished only by a prior reheating method explained hereinafter through a continuous annealing line without causing disadvantage and inconvenience resulting from the reheating method by firstly quenching at a specific cooling rate a steel sheet having a specific component composition, which has been subjected to a final rolling in hot rolling, maintaining the quenched steel sheet at a specifically defined temperature range and then subjecting the thus treated steel sheet to second quenching at a specific cooling rate, whereby the hot-rolled steel sheet having the above described properties can be advantageously produced.

Recently, the demand of high tensile strength thin steel sheets has been rapidly increased mainly in automotive field and this aims to ensure the safety of drivers, reduce the car weight and improve the fuel cost and this demand is required in the application other than automobiles for intending the increase of the toughness of the structure and the decrease of the weight of the structure.

In these applications, the thin steel sheets of a base material is usually subjected to a cold molding step, such as press forming and therefore such a sheet is required to have excellent cold formability.

As one means for satisfying the cold formability which is inconsistent with respect to high tensile strength steel sheets, it has been known that a metal structure is composed of a mixed structure (referred to as dual phase structure" hereinafter) wherein ferrite phase and martensite phase are dispersed and steels having such a dual phase structure show unique mechanical properties, that is low yield point, high tensile strength, and further very excellent strength-elongation balance and therefore these steel sheets are excellent in the cold formability.

The excellent cold formability of the dual phase structured high tensile strength thin steel sheets is due to the low yield ratio and the high ductility because the strength at a low strain zone is determined by a soft ferrite phase and the strength at a high strain zone is determined by a hard martensite phase (referred to as "the hard second phase" hereinafter). Furthermore, in these steel sheets, the work hardening is very high upon working and the yield strength is increased owing to the age hardening after the molding, so that the strength in the final product is not inferior to that of the general high tensile strength steel and these steel sheets have very practically useful properties.

The present invention can advantageously provide high tensile strength steel sheets having excellent properties due to the dual phase structure and occupies the technical field concerning the production.

BACKGROUND OF THE INVENTION

The most general method for producing the above described dual phase structured steel sheets comprises reheating a thin steel sheet up to $\gamma+\alpha$ zone by using a heat-treating apparatus of a prior continuous annealing line and then rapidly quenching the reheated steel sheet in the subsequent cooling step to transform $\gamma$ portion formed in the heating step into martensite (referred to as "reheating method" hereinafter). But it is essential for the reheating method to add one step for the heat treatment and is not advantageous in view of economy and productivity.

On the other hand, it has been known to directly obtain the dual phase structure in a hot-rolling step without effecting the separate heat treating step (referred to as "hot-rolling method" hereinafter) but the cold formability of the dual phase structured steel sheets produced in the prior hot-rolling method is far inferior to that of the steel sheets produced in the above described reheating method.

In order to improve the cold formability of the steel sheets having a high tensile strength of more than 50 kg/mm$^2$, which are mainly used in automotive field hereafter, it is necessary that the yield ratio YR is less than 70%, preferably less than 65% and the following value M of the strength-elongation balance parameter which is clarified and proposed by the inventors as an indication of the cold formability $$M=0.45TS+El$$

wherein TS is tensile strength (kg/mm$^2$) and El is total elongation (%), is 60 or more, but the dual phase structured steel sheets produced in the prior hot-rolling method can not reach the level satisfying this value and these requirements are satisfied only by the above described reheating method.

In general, the yield ratio and the strength-elongation balance of the dual phase structured high tensile strength steel shets vary depending upon the mixing ratio of ferrite phase to the hard second phase, the state of the hard second phase dispersed and ferrite grain size and the like and in order to obtain the above described yield ratio and parameter value M of strength-elongation balance, it is necessary that the ferrite fraction is more than 75%, the hard second phase is finely and uniformly dispersed and ferrite grain size is satisfactorily large.

When pearlite and bainite are mixed in the structure, the mechanical properties are considerably deteriorated.

In the practical hot-rolling operation, the actual necessary time from a final finishing roller to a coiler is about 10–40 seconds and the cooling means in a run-out table is limited to either of a laminate flow, water cooling through jet or air cooling, so that the hot-rolling process is less in the freedom for controlling the cooling condition than the reheating method and the hot-rolling method has a further problem in this point.

Therefore, in the case of the hot-rolling method, it is necessary to take into careful consideration so that the dual phase structure defined as described above can be obtained under the severely limited condition range.

Even though the actual transforming phenomenon caused in the hot-rolling step should be fully clarified and checked in order to overcome such a difficulty, it has never been attempted to fully check the three optimum conditions of the chemical components, rolling condition and cooling condition which are factors influencing upon the transforming behavior and further although these influencing factors have the mutual correlation, this point has never been taken into consideration.

Thus, when the prior hot-rolling method is checked in view of these points, said method has not been satisfied.

Discussion will be made hereinafter with respect to the problems of the already proposed main methods for producing the dual phase structured high tensile strength steel sheets through hot-rolling method and to the difference between these methods and the method of the present invention.

A first prior method, for example, Japanese Patent Laid Open Specification No. 34,659/80 or No. 62,121/80, provides that a part of the final rolling is carried out in a temperature range of two phases of $\gamma+\alpha$ to effect a means for promoting the transformation of $\gamma$ into $\alpha$ owing to the strain induction and then a cooling condition in which stay time at a temperature range at which $\gamma$ is easily transformed into $\alpha$ is prolonged as far as possible, is adopted. However, in these methods, the drawback owing to the rolling in the two phase zone can not be avoided, so that when the rolling in the two phase zone is effected, ferrite phase and martensite phase in the final structure show the fiber-like dispersed state and anisotropy of mechanical properties due to this state is caused and the rolling strain remains in ferrite grains, so that the elongation property is deteriorated and the increase of the ferrite fraction mainly relies upon the increase of number of ferrite grains, so that the ferrite grains becomes fine and therefore the yield ratio becomes relatively higher.

In these methods, it has been difficult as mentioned hereinafter to obtain the steel sheets of a yield ratio YR≦65% and a parameter M of strength-elongation balance=[0.45TS+El]≧60. A prior second method, as shown in, for example Japanese Patent Laid Open Specification No. 65,118/79 provides that after completing the final rolling at a temperature of higher than $Ar_3$ point, cooling is discontinued when the temperature of a steel sheet becomes within a range of $Ar_3$–$Ar_1$ in the course of rapid quenching of the steel sheet which has finished the final rolling at a temperature of higher than $Ar_3$ point, on the run-out table, and the temperature is held for a given time and then the rapid quenching is again effected. This method intends to effectively progress the transformation of $\gamma$ into $\alpha$ during the intermediate holding time but does not cause the quality drawbacks as in the case of the above described rolling in the two phase zone and is an excellent idea in view of effective use of the limited time but even though the optimum cooling condition strongly relies upon the chemical components of the base material and the rolling hysteresis at the upper stream steps, these points are neglected and a mere two stage of cooling or a broad holding temperature range of $Ar_3$–$A_1$ is only set, so that a high improvement of quality can not be attained. That is, the problem of the method of this prior art consists in that the countermeasurement regarding the above described points has not been yet clarified. When a trial calculation is made with respect to the examples in this publication, the quality level does not satisfy the yield ratio YR≦60%, and the parameter M of strength-elongation balance=[0.45TS+El]≧60 and is substantially equal to that of the prior hot-rolling method.

In this prior publication, a simple C—Si—Mn system is only selected and it has never been noticed to use more advantageous C—Si—Mn—Cr system for forming the dual phase structure in view of the transforming property.

SUMMARY OF INVENTION

The present invention has clarified the strict cooling conditions following to the hot final rolling for obtaining the best quality, whereby the condition range can be always easily defined even when the chemical components and the rolling condition are varied.

The present invention has been made in order to advantageously improve the above described all problems of the prior methods and is constructed with the essential matters which define three optimum requirements of the chemical components of the base material, the temperature when the final rolling is finished and the cooling condition on the run-out table. The present invention provides a method for producing dual phase structured steel sheets having a low yield ratio, a high tensile strength, an excellent shape stability in formed articles and a low variation in coil, which have more excellent cold formability than the reheating method, that is a yield ratio YR≦65% and a parameter M of strength-elongation balance≧60.

The present invention lies in a method for producing hot-rolled steel sheets having a low yield ratio and a high tensile strength due to dual phase structure, characterized in that when a hot-rolled steel sheet containing 0.02–0.2% by weight of C, 0.05–2.0% by weight of Si, 0.5–2.0% by weight of Mn and 0.3–1.5% by weight of Cr as the essential components, and if necessary at least one element selected from each group of the first group components consisting of not greater than 1% by weight of Cu, Ni and Mo and not greater than 0.02% by weight of B, the second group components consisting of not greater than 0.2% by weigh of Nb, V and Ti and the third group components consisting of not greater than 0.05% by weight of REM and Ca, and not greater than 0.1% by weight of Al and not greater than 0.15% by weight of P as a preferable component, is cooled on a run-out table after final rolling and then coiled, a temperature FT when the final rolling is finished, is higher than 780° C., the final rolled steel sheet is rapidly quenched at a cooling rate of more than 40° C./S from the completion of the final rolling to a temperture range from a temperature $T_N$, shown by the following formula (1), +40° C. to the temperature $T_N$−40° C., is held at said temperature range for more than 5 seconds and then again rapidly quenched at a cooling rate of more than 50° C./S from the held temperature to a temperature range of 550°–200° C., whereby a hot-rolled steel sheet having the yield ratio≦65% and the parameter M of strength-elongation balance shown in the following formula (2)≧60 and low variation of steel qualities and excellent cold formability is obtained.

$$T_N = 582 + 44Si\,\% - 33Mn\,\% + 25Cr\,\% - 3Cu\,\% - 9Ni\,\% + 5Mo\,\% + (0.8 - C\,\%)(48 - 25Si\,\% + 57Mn\,\% - 15Cr\,\% + 10Cu\,\% - 15Ni\,\% - 28Mo\,\%) + 70\exp\left\{-\left(\frac{FT(^\circ C.) - 780}{100}\right)^4\right\} \quad (1)$$

-continued $$M = 0.45TS + El \quad (2)$$

wherein TS is tensile strength (kg/mm$^2$) and El is total elongation (%). The reason why C—Si—Mn—Cr system chemical components are particularly defined as a base material of hot-rolling steel sheet in the present invention is as follows.

C:

C is an element important for improving the hardenability and the strength of martensite by being diffused and transferred into $\gamma$ phase in the transformation of $\gamma$ into $\alpha$ in the course of cooling, but when the amount is excessive, the fraction of the second phase becomes excess and the formability is deteriorated and the weldability is adversely affected, so that the moderate range is 0.02–0.20%.

Si:

This element is high in the solid solution hardening and can increase the strength without deteriorating the yield ratio and the strength-elongation balance and activates the transformation of $\gamma$ into $\alpha$ and promotes the enrichment of C into $\gamma$ phase. Thus, this element has useful properties for forming the dual phase structure and further improves the refining ability of steel as a de-oxidizing element and the content of 0.5% or more is very effective but when the content exceeds 2.0%, the effect is saturated and the economical disadvantage is brought about, so that the content is 0.05–2.0%.

Mn:

This element is a relatively inexpensive alloying element for improving the hardenability of steels and is a main element of additive alloying components and needs at least 0.5% in order to ensure the hardenability of steels but when the amount exceeds 2.0%, the weldability is adversely effected and the rate of transforming $\gamma$ into $\alpha$ is decreased and the tendency of increasing the fraction of the second phase is shown, so that the content is defined to be 0.5–2.0%.

Cr:

This element is an element for improving the hardenability as well known and is a particularly important element in the present invention. That is, other elements for improving the hardenability have generally a function for retarding the transformation of $Ar_3$ and therefore have an adverse influence upon the increase of the fraction of ferrite but Cr does not give a great influence upon the transformation of $Ar_3$ and serves to improve the stability of the remaining $\gamma$ phase and makes the formation of the dual phase structure easy. In order to develop this effect, a content of at least 0.3% is necessary and the upper limit is defined to be 2% in view of the economy. When it is intended to reduce variation of the quality in the coil, it is preferable to contain at least 0.5%.

Other than the above described essential components, the selective components as described hereinafter may be contained in the present invention, whereby the desired effects can be further improved.

Cu, Ni, Mo:

Cu has effect of solid solution hardening, Ni has effect for improving solid solution hardening and hardenability and Mo has effect for immproving hardenability and these elements are the equivalent elements in view of the contribution to increase of strength in an amount of not greater than 1%. But any of these elements are expensive and when the total amount exceeds 1%, such an amount is not economic, so that the upper limit is defined to be 1%.

B:

B is a useful element for increasing the stability of the quality, because this element has the same effect as the above described components in a small amount of not greater than 0.02% regarding the function of increasing the strength owing to improvement of hardenability and further makes the formation of the dual phase structure easy. But this effect is saturated in an amount of exceeding 0.02%, so that the upper limit is defined to be 0.02%.

Nb, Ti, V:

These elements have very high effect for restraining formation of fine grains and recrystallization of $\gamma$ grains, so that when a moderate amount of not greater than 0.2% is contained, the rate of transforming $\gamma$ into $\alpha$ after the final rolling can be increased by means of these elements, so that these elements are useful. However, when said amount exceeds 0.2%, the precipitation hardening becomes high and the yield ratio is increased, so that such an amount is not desirable and the upper limit of any elements is defined to be 0.2%. Ca and REM (Ce+La) bond to S in steels which gives adverse influence upon the mechanical properties, to restrain the harm of S, so that the use of these elements is very effective but when the amount exceeds 0.05%, the refining degree is reversely degraded and the mechanical properties are deteriorated, so that the upper limit is defined to be 0.05%.

Al:

If this element is used as a deoxidizing element, the refining ability of steels is improved and the formability is improved but the effect is saturated at 0.10%, so that the upper limit is 0.10%.

P:

This element has the similar property to Si in view of the solid solution hardening and the activation of transformation of $\gamma$ into $\alpha$ and if the amount is not greater than 0.15%, even when this element is positively added to an amount which exceeds the amount as an incidental impurity, there is no problem but when the amount exceeds 0.15%, the segregation is caused in the steels whereby the mechanical properties are deteriorated and the weldability or the fatigue property is adversely affected, so that the amount is limited to 0.1%.

The most important point in the course of formation of the dual phase structure in the hot-rolling method is the step where polygonal ferrite is precipitated from $\gamma$ phase at the point where the final rolling is completed, because the delay of this precipitation has direct relation to reduction of the fraction of ferrite in the final structure and indirect relation to deficiency of enrichment of C into the remaining $\gamma$ phase due to the precipitation of ferrite, and the hardenability is lowered and the fear of mixture of pearlite and bainite into the hard second phase is increased.

The cooling condition of the present invention are based on the above described viewpoints and the principal object lies in that the transformation of $\gamma$ into $\alpha$ is progressed to the maximum limit within the limited cooling time on the run-out table and the content consists of three stages of cooling step as shown in FIG. 1. Explanation will be made hereinafter with respect to the function and the reason of defining the condition in each stage with reference to FIG. 1.

The transformation property after the hot-rolling is varied by the rolling hysteresis other than the chemical components of the base material and particularly the latter influence upon the transforming behavior of $\gamma$ into $\alpha$ is high, and as the size of $\gamma$ grains when completing the hot-rolling is finer and the working strain amount in $\gamma$ grains is larger, the transformation of $\gamma$ into $\alpha$ is promoted. However, when a usual steel finishes rolling at a temperature of higher than $Ar_3$ point, the worked $\gamma$ grains are rapidly recovered and cause the recrystallization immediately after completion of rolling and the above described phenomenon is relaxed. Accordingly, the cooling in the first stage in FIG. 1 mainly aims at satisfactorily restraining this recovery and recrystalliztion and to maintain the cooling to the temperature range where the transformation of $\gamma$ into $\alpha$ is efficiently caused and in order to obtain this effect, the cooling rate $\alpha_1$ from the temperature when the final rolling is finished to the transforming temperature range must be a rapid quenching of a cooling rate of more than 40° C./S. When $\alpha_1$ is slower than this rate, the above described effect disappears and therefore the low yield ratio and the strength-elongation balance aimed in the present invention can not be obtained and the loss of the necessary time occurs. The reason why the temperature range when the first stage of rapid quenching is finished, is defined, is determined by the object of the second stage mentioned hereinafter. The rate of transforming $\gamma$ into $\alpha$ depends upon the nucleus forming rate and the nucleus growing rate and the temperature range at which these rates becomes maximum, is present. Therefore, in order to efficiently progress the transformation of $\gamma$ into $\alpha$, it is desirable that the stay time within this temperature range is made longer as far as possible and the holding at the second stage in this invention is effected for this purpose and for the purpose, the holding at the temperatur range of from $T_N+40°$ C. to $T_N-40°$ C. for more than 5 seconds is necessary.

$T_N$ as seen from the above described formula (1), depends upon the components in the steel and the temperature FT when the final rolling is finished, among the hot-rolling hysteresis, but fairly greatly varies depending upon the components and the inventors have made experiments in a broad range and found the relation of the above described formula (1) which fits advantageously to the object of the present invention. When $T_N$ is not covered by the above described range, the following objects of the present invention can not be attained (see Examples).

$$YR \leqq 65\%$$

$$[0.45TS+El] \geqq 60$$

The upper limit of the holding time is not determined by the mechanical properties but the time is limited to 30 seconds in view of the time limit of the processing step but if the problems of the productivity and installation are neglected, it is permissible to exceed the defined range and, for example when a heat insulating means or a heating means for this purpose is provided on the run-out table, the better results can be expected. The third range of cooling is effected for transforming the untransformed $\gamma$ phase into martensite and the essential matter consists in to prevent the transformation into pearlite and bainite and it is not always necessary to cause the transformation into martensite in this cooling step. In the present invention, the cooling rate $\alpha_2$ must be more than 50° C./S and the temperature when the cooling is finished must be lower than 550° C. The reason why the lower limit of the temperature when the cooling is finished is defined to be 200° C. is as follows. When the rapid quenching is effected to a temperature of lower than 200° C., there is no chance that C present in solid solution in imbalance in ferrite phase is precipitated and the mechanical deterioration is brought about in the product, so that such a temperature is not preferable. When the temperature when the cooling is finished is lower than 400° C., the timing of transformation into martensite is not coincident in the transversal direction and the longitudinal direction of the steel sheet and an inferior form is caused, that is waveforms are formed at the transversal edge portions of the sheet. Therefore, in order to avoid this defect, it is preferable to select the temperature when the cooling is finished, within the temperature range of 400° C.-550° C.

By satisfying the above described cooling conditions from the finishing of the hot-rolling to the coiling, the yield ratio YR value becomes 65% or less and the parameter M of the strength-elongation balance becomes 60 or more. In the above described Japanese Patent Laid Open Specification No. 65,118/79, it has been attempted that the parameter M of strength-elongation balance is estimated by the product of the tensile strength with the elongation as an indication of strength-elongation balance. The inventors have studied in detail this balance with respect to the relation of the formation of cracks or neckings caused upon molding of parts of structures subjected to various high grade of complicated deformations, such as projecting deformation, curving deformation, elongating frange deformation and the like as in the molding of wheel disc of automotive parts to the tensile strength, TS, total elongation and El of the materials to be molded, and found that the adoption of the value of 0.45TS+El as the parameter satisfies the actual requirement as the indication of the cold formability of the materials to be molded, which shows the limit of forming cracks and neckings in the above described molding.

BEST MODE OF CARRYING OUT THE INVENTION

Figure 1:
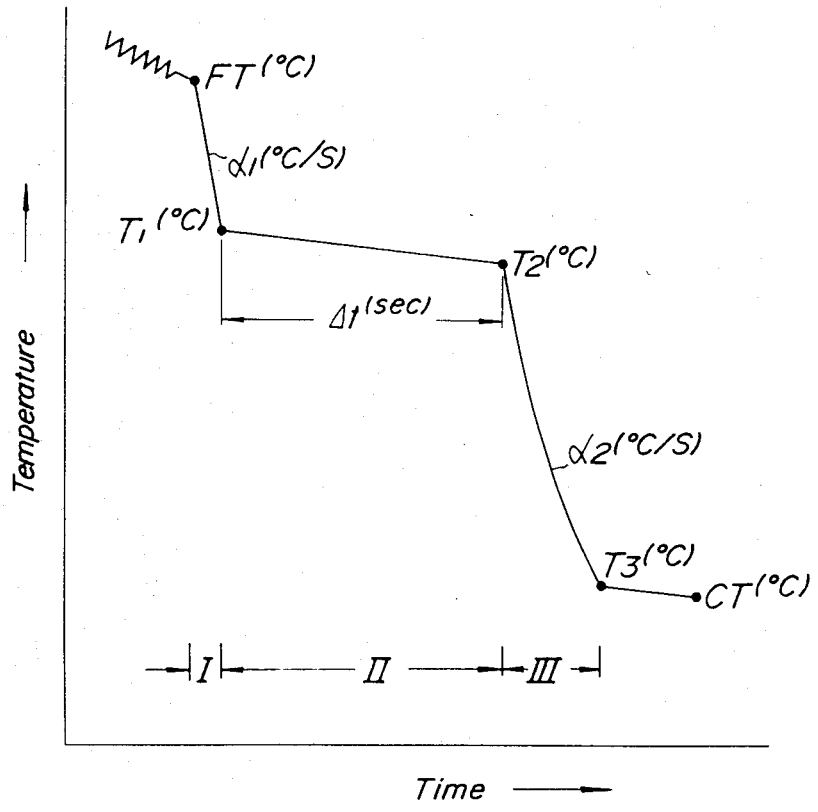
FIG. 1 is a graph for illustrating the cooling requirements of the present invention.

The tensile properties (JIS No. 5 tensile test piece) of hot-rolled steel strips (2.8 mmt) produced by hot-rolling steels having chemical composition shown in Table 1 under the conditions shown in Table 2 are shown in Table 2.

In Table 1, steel A is a comparative sample, steels B-E consist of the essential composition of C-Si-Mn-Cr system and steels F-N are samples containing additionally the selective components.

TABLE 1

| | (wt. %) | | | | | | | | | | | | | | | |
|---|---|---|---|---|---|---|---|---|---|---|---|---|---|---|---|---|
| | C | Si | Mn | P | S | Al | Cr | Cu | Ni | Mo | B | Nb | V | Ti | REM | Ca |
| A | 0.07 | 1.02 | 1.52 | 0.015 | 0.007 | 0.015 | — | — | — | — | — | — | — | — | — | — |
| B | 0.06 | 0.98 | 1.23 | 0.012 | 0.006 | 0.021 | 0.95 | — | — | — | — | — | — | — | — | — |
| C | 0.05 | 1.00 | 1.25 | 0.016 | 0.007 | 0.005 | 0.35 | — | — | — | — | — | — | — | — | — |
| D | 0.05 | 1.04 | 1.24 | 0.014 | 0.009 | 0.008 | 0.57 | — | — | — | — | — | — | — | — | — |
| E | 0.05 | 0.97 | 1.24 | 0.009 | 0.012 | 0.013 | 1.29 | — | — | — | — | — | — | — | — | — |
| F | 0.06 | 1.31 | 1.35 | 0.018 | 0.015 | 0.035 | 1.16 | — | 0.25 | — | — | — | — | — | — | — |
| G | 0.06 | 1.05 | 1.39 | 0.021 | 0.011 | 0.033 | 1.09 | — | — | 0.30 | — | — | — | — | — | — |
| H | 0.06 | 0.95 | 1.33 | 0.013 | 0.014 | 0.027 | 1.20 | 0.30 | — | — | — | — | — | — | — | — |
| I | 0.04 | 0.15 | 1.57 | 0.015 | 0.005 | 0.019 | 1.40 | — | — | — | — | 0.021 | — | — | — | — |
| J | 0.07 | 0.16 | 1.55 | 0.014 | 0.003 | 0.040 | 0.35 | — | — | — | — | — | 0.050 | — | — | — |
| K | 0.08 | 0.70 | 1.25 | 0.017 | 0.006 | 0.009 | 0.80 | — | — | — | — | — | — | 0.032 | — | — |
| L | 0.10 | 1.20 | 0.80 | 0.019 | 0.008 | 0.025 | 0.56 | — | — | — | 0.009 | — | — | — | — | — |
| M | 0.05 | 1.03 | 1.32 | 0.015 | 0.005 | 0.018 | 0.95 | — | — | — | — | — | — | — | 0.021 | — |
| N | 0.05 | 1.01 | 1.28 | 0.014 | 0.003 | 0.033 | 0.97 | — | — | — | — | — | — | — | — | 0.0008 |

TABLE 2

| Sample No. | Test steel | $T_N$ (°C.) | FT (°C.) | $\alpha_1$ (°C./S) | $T_1$ (°C.) | Δt (sec) | $T_2$ (°C.) | $\alpha_2$ (°C./S) | $T_3$ (°C.) | CT (°C.) | YS (0.2) (kg/mm²) | TS (kg/mm²) | El (%) | $YR = \frac{YS_{0.2}}{TS} \times 100$ (%) | M = (0.45 TS + El) | Remarks |
|---|---|---|---|---|---|---|---|---|---|---|---|---|---|---|---|---|
| 1 | A | 718 | 840 | 75 | 730 | 5 | 710 | 125 | 460 | 460 | 43.5 | 57.2 | 30.9 | 76 | 56.6 | Comparative method |
| 2 | " | " | " | " | 750 | 12 | 700 | " | " | " | 43.6 | 55.9 | 33.8 | 78 | 58.9 | Comparative method |
| 3 | " | " | " | " | " | " | " | " | 350 | 350 | 43.6 | 62.3 | 29.9 | 70 | 57.9 | Comparative method |
| 4 | B | 735 | 820 | — | 820 | 8 | 770 | " | 470 | 470 | 50.5 | 72.1 | 23.9 | 70 | 56.3 | Comparative method |
| 5 | " | " | " | 75 | 800 | 9 | 750 | " | 460 | 460 | 46.4 | 69.3 | 25.6 | 67 | 56.8 | Comparative method |
| 6 | " | " | " | " | 790 | 10 | 740 | " | 465 | 465 | 42.7 | 67.8 | 27.1 | 63 | 57.6 | Comparative method |
| 7 | " | " | " | " | 780 | 11 | 730 | " | 470 | 470 | 39.1 | 65.2 | 29.3 | 60 | 58.6 | Comparative method |
| 8 | " | " | " | " | 770 | 12 | 720 | " | 465 | 465 | 36.1 | 63.3 | 34.1 | 57 | 62.6 | Present invention |
| 9 | " | " | " | " | 760 | " | 710 | " | 460 | 460 | 35.7 | 62.7 | 34.9 | 57 | 63.1 | Present invention |
| 10 | " | " | " | " | 750 | " | 700 | " | 455 | 455 | 36.5 | 61.9 | 34.3 | 59 | 62.1 | Present invention |
| 11 | " | " | " | " | 740 | 13 | 690 | " | 460 | 460 | 39.7 | 60.2 | 32.5 | 66 | 59.6 | Comparative method |
| 12 | " | " | " | " | 730 | " | 680 | " | 465 | 465 | 41.5 | 59.3 | 31.6 | 70 | 58.3 | Comparative method |
| 13 | " | " | " | " | 720 | 14 | 670 | " | " | " | 44.0 | 58.6 | 32.3 | 75 | 58.7 | Comparative method |
| 14 | " | " | " | 25 | 765 | 12 | 700 | " | 450 | 450 | 48.1 | 68.7 | 26.3 | 70 | 57.2 | Comparative method |
| 15 | " | " | " | 75 | 770 | 2 | 755 | " | 460 | 460 | 47.8 | 67.4 | 26.8 | 69 | 57.1 | Comparative method |
| 16 | " | " | " | " | 760 | 12 | 700 | 10 | 470 | 470 | 46.6 | 57.5 | 31.4 | 81 | 57.3 | Comparative method |
| 17 | " | " | " | " | 760 | 12 | 710 | 125 | 620 | 600 | 47.4 | 57.8 | 30.1 | 82 | 56.1 | Comparative method |
| 18 | C | 728 | " | " | 740 | 8 | 710 | " | 440 | 435 | 37.9 | 60.2 | 33.5 | 63 | 60.6 | Present invention |
| 19 | D | 732 | " | " | 750 | " | 715 | " | 410 | 400 | 38.2 | 62.6 | 33.0 | 61 | 61.2 | Present invention |
| 20 | E | 741 | " | " | 755 | " | 725 | " | 440 | 440 | 36.6 | 66.5 | 32.9 | 55 | 62.8 | Present invention |
| 21 | F | 744 | 800 | 75 | 765 | 14 | 725 | 125 | 510 | 500 | 43.8 | 69.5 | 30.2 | 63 | 61.5 | Present invention |
| 22 | G | 723 | 850 | " | 770 | " | 710 | " | 490 | 490 | 41.7 | 70.7 | 29.9 | 59 | 61.7 | Present invention |
| 23 | H | 742 | 780 | " | 765 | " | 720 | " | 375 | 370 | 40.9 | 67.1 | 31.2 | 61 | 61.4 | Present invention |
| 24 | I | 683 | 880 | " | 695 | 8 | 670 | " | 455 | 455 | 35.6 | 56.5 | 36.9 | 63 | 62.3 | Present invention |
| 25 | J | 694 | 850 | " | 715 | 16 | 665 | " | 505 | 490 | 38.1 | 59.6 | 35.7 | 64 | 62.5 | Present invention |
| 26 | K | 718 | 840 | " | 755 | 20 | 680 | " | 490 | 480 | 41.2 | 64.3 | 33.7 | 64 | 62.6 | Present invention |
| 27 | L | 731 | 790 | " | 760 | 28 | 695 | " | 425 | 425 | 40.2 | 64.8 | 32.1 | 62 | 61.3 | Present invention |
| 28 | M | 740 | 800 | " | 750 | 12 | 710 | " | 410 | 410 | 33.7 | 60.1 | 36.6 | 56 | 63.6 | Present invention |

TABLE 2-continued

| Sample No. | Test steel | $T_N$ (°C.) | FT (°C.) | $\alpha_1$ (°C./S) | $T_1$ (°C.) | Δt (sec) | $T_2$ (°C.) | $\alpha_2$ (°C./S) | $T_3$ (°C.) | CT (°C.) | YS (0.2) (kg/mm²) | TS (kg/mm²) | El (%) | YR = $\frac{YS_{0.2}}{TS}$ × 100 (%) | M = (0.45 TS + El) | Remarks |
|---|---|---|---|---|---|---|---|---|---|---|---|---|---|---|---|---|
| 29 | N | 731 | 840 | " | 735 | " | 700 | " | 420 | 420 | 34.7 | 60.8 | 36.0 | 57 | 63.4 | Present invention |

Note:
$\alpha_1$ . . . Primary cooling rate
$\alpha_2$ . . . Secondary cooling rate
$T_1$ . . . Temperature when finishing the primary cooling.
$T_2$ . . . Temperature when finishing the intermediate step.
$T_3$ . . . Temperature when finishing the secondary cooling.
Δt . . . Intermediate holding time
CT . . . Coiling temperature.
YS . . . Yield point (stress corresponding to 0.2% of permanent strain).

Figure 2:
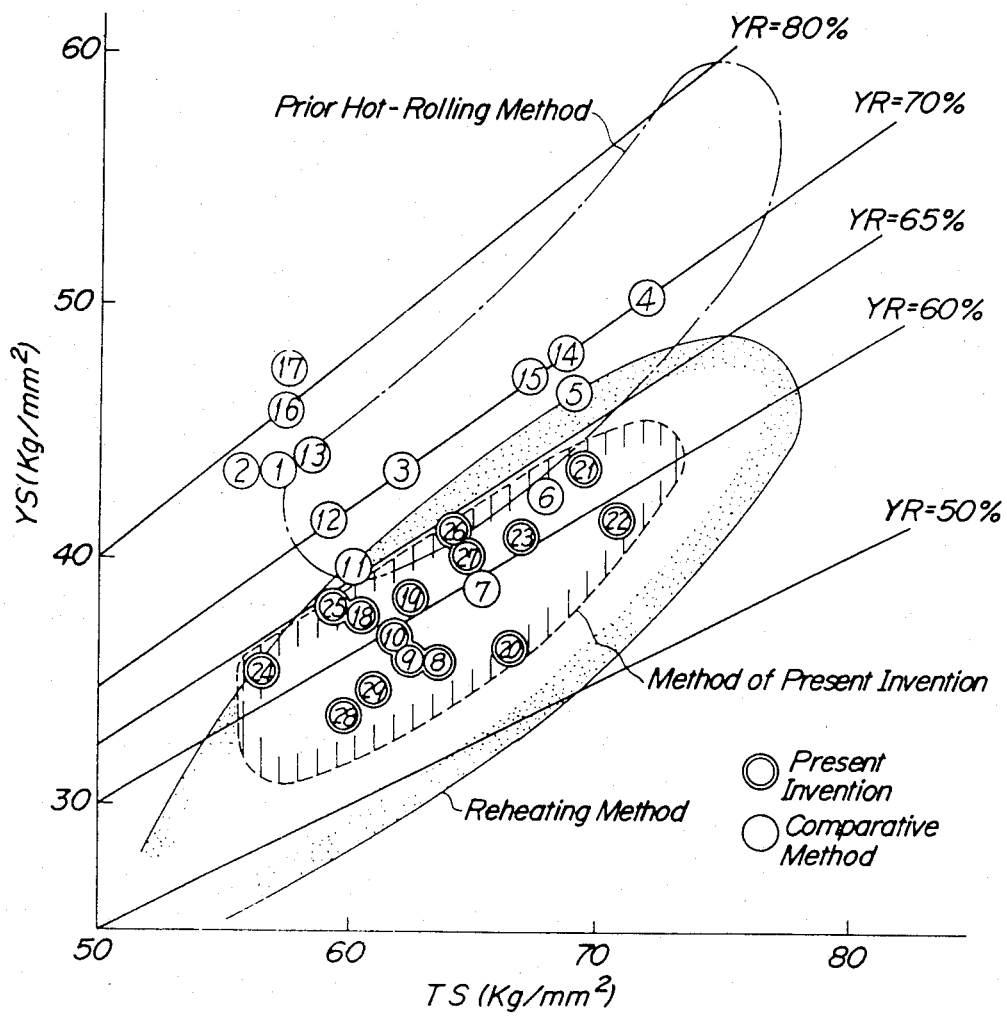
FIG. 2 and FIG. 3 are graphs showing the relations of YS to TS and El to TS with respect to the prior dual phase structured steel sheets and examples of the present invention.
Figure 3:
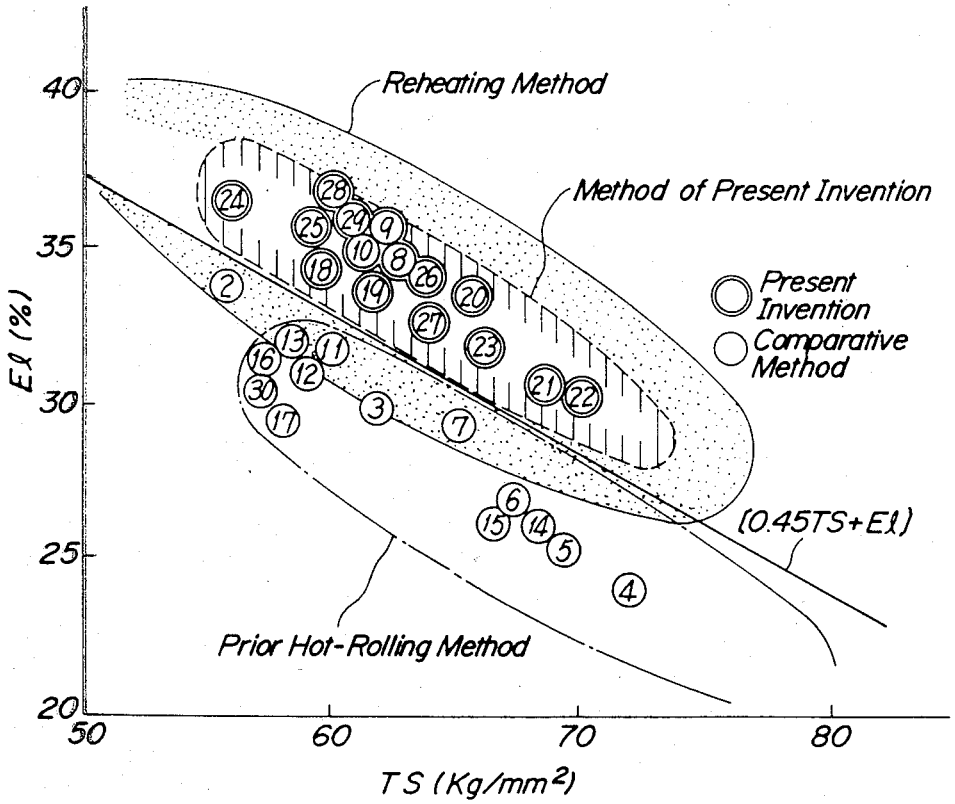

The results in Table 2 are arranged in the correlation of TS-YS and TS-El and the obtained results are shown in FIG. 2 and FIG. 3.

The following facts are found from Table 2, FIG. 2 and FIG. 3.

(1) In the steels of which the chemical components are not covered by the range of the present invention, even if the hot-rolling condition follows to the method of the present invention, the following requirements can not be attained.

$$YR \leqq 65\%, \quad M \geqq 60,$$

(Sample Nos. 1, 2 and 3)

(2) If the chemical composition is within the range of the present invention, even if the selective components are used, the steel qualities aimed in the present invention can be obtained (Sample Nos. 18–29).

(3) When the cooling conditions are not covered by the range of the present invention, the aimed steel qualities can not be obtained. (Sample Nos. 4–7, 11–13 do not satisfy the requirement of temperature $T_1$ or $T_2$. Sample No. 15 does not satisfy the requirement of Δt. Sample Nos. 14 and 16 do not satisfy the requirement of $\alpha_1$ or $\alpha_2$. Sample No. 17 does not satisfy the requirement of $T_3$).

(4) The mechanical properties of the steel sheets produced following to the requirements of the present invention are far more excellent than the dual phase structured steel sheets produced in the prior hot-rolling method and are substantially equal to the best properties in the prior reheating method.

As mentioned above, according to the present invention, the dual phase structure can be effectively controlled only by defining the composition of the hot-rolled steel sheets and the cooling condition after completing the final rolling to the coiling, and the properties of the steel sheets, which are much more excellent than those in the case of the prior hot rolling method and can be comparable to the best results in the reheating method, can be easily obtained without needing the reheating step or the similar procedure and the low yield ratio due to the above described dual phase structure can be realized without varying the quality and the cold formability of the high tensile strength hot rolled steel sheets can be greatly improved.

We claim:

1. Method for producing hot-rolled steel sheets having a low yield ratio and a high tensile strength due to dual phase structure, comprising cooling a hot-rolled steel sheet containing 0.02–0.2% by weight of C, 0.05–2.0% by weight of Si, 0.5–2.0% by weight of Mn, and 0.3–1.5% by weight of Cr, and at least one element selected from each of a first group components consisting of up to 1% by weight of Cu, Ni or Mo, and 0–0.02% by weight of B, a second group component consisting of up to 0.2% by weight of Nb, V, and Ti and a third group components consisting of up to 0.05% by weight of REM and Ca, and up to 0.01% by weight of Al and up to 0.15% by weight of P, on a run-out table after final rolling and then coiling thereof, a temperature FT when the final rolling is finished, being higher than 780° C., rapidly quenching the final rolled steel sheet at a cooling rate of more than 40° C./S from the completion of the final rolling to a temperature range from a temperature $T_N$, shown by the following formula (1), +40° C. to the temperature $T_N$−40° C., holding at said temperature range for more than 5 seconds and then again rapidly quenching the steel sheet at a cooling rate of not more than 50° C./S from the held temperature to a temperature range of 550°–200° C., whereby a hot-rolled steel sheet having the yield ratio≦65% and the parameter M of strength-elongation balance shown in the following formula (2)≧60 and low variation of steel qualities and excellent cold formability is obtained $$T_N = 582 + 44Si\,\% - 33Mn\,\% + 25Cr\,\% - 3Cu\,\% - 9Ni\,\% + 5Mo\,\% + (0.8 - C\,\%)(48 - 25Si\,\% + 57Mn\,\% - 15Cr\,\% + 10Cu\,\% - 15Ni\,\% - 28Mo\,\%) + 70\exp\left\{-\left(\frac{FT(°C.) - 780}{100}\right)^4\right\} \quad (1)$$

$$M = 0.45TS + El \quad (2)$$

wherein TS is tensile strength (kg/mm²) and El is total elongation (%).

2. The method according to claim 1, wherein the cooled hot-rolled steel sheet contains 0.02–0.2% by weight of C, 0.05–2.0% by weight of Si, 0.5–2.0% by weight of Mn, and 0.3–1.5% by weight of Cr as the essential components, and at least one element selected from each of the first group components consisting of up to 1% by weight of Cu, Ni, or Mo, and up to 0.02% by weight of B, the second group components consisting of up to 0.2% by weight of Nb, V and Ti, and the third group selected component consisting of up to 0.15% by weight of P.

* * * * *